US006915779B2

(12) United States Patent
Sriprakash

(10) Patent No.: US 6,915,779 B2
(45) Date of Patent: Jul. 12, 2005

(54) PEDAL POSITION RATE-BASED ELECTRONIC THROTTLE PROGRESSION

(75) Inventor: Bhargav Sriprakash, Ann Arbor, MI (US)

(73) Assignee: General Motors Corporation, Detroit, MI (US)

( * ) Notice: Subject to any disclaimer, the term of this patent is extended or adjusted under 35 U.S.C. 154(b) by 21 days.

(21) Appl. No.: 10/601,613

(22) Filed: Jun. 23, 2003

(65) Prior Publication Data

US 2004/0255906 A1 Dec. 23, 2004

(51) Int. Cl.[7] ..... F01D 41/00
(52) U.S. Cl. ..... 123/361; 123/399
(58) Field of Search ..... 123/361, 399, 123/376, 378, 402, 403

(56) References Cited

U.S. PATENT DOCUMENTS 4,691,676 A * 9/1987 Kikuchi ..... 123/399
4,735,181 A * 4/1988 Kaneko et al. ..... 123/361
4,799,467 A * 1/1989 Ishikawa et al. ..... 123/399
5,255,653 A * 10/1993 Ironside et al. ..... 123/399
5,431,139 A * 7/1995 Grutter et al. ..... 123/198 F
6,526,941 B1 3/2003 McDonald et al.
6,637,382 B1 * 10/2003 Brehob et al. ..... 123/25 J
6,687,602 B2 2/2004 Ament
6,705,287 B2 * 3/2004 Kuenstler et al. ..... 123/399

* cited by examiner

*Primary Examiner*—John T. Kwon
(74) *Attorney, Agent, or Firm*—Christopher DeVries

(57) ABSTRACT

An engine control system in a vehicle including an internal combustion engine, an electronic throttle controlling air flow to the internal combustion engine, a controller controlling the position of the electronic throttle, an accelerator pedal having an accelerator pedal sensor that generates a signal to the controller, and where the controller computes a rate of change for the accelerator pedal and actuates the electronic throttle to a desired position based upon the rate of change for the accelerator pedal.

14 Claims, 3 Drawing Sheets

PEDAL POSITION RATE-BASED ELECTRONIC THROTTLE PROGRESSION

TECHNICAL FIELD

The present invention relates to the control of internal combustion engines. More specifically, the present invention relates to a method and apparatus to control an electronic throttle.

BACKGROUND OF THE INVENTION

Electronic engine control has evolved from mechanical control systems employing simple switches and analog devices to a highly precise fuel and ignition control system employing powerful electronics. The miniaturization and cost reduction of electronics has put the power of the computer age into the hands of automotive engineers. Microprocessors have allowed complex programs involving numerous variables to be used in the control of present day combustion engines, leading to better engine control and performance.

An important facet of combustion engine control is the regulation of air flow into a cylinder by a throttle and accordingly the quantity of fuel delivered into the cylinder. In an internal combustion engine (ICE), a throttle, having a movable throttle plate, directly regulates the power produced by the ICE at any operating condition by regulating the air flow into the ICE. The throttle plate is positioned to increase or decrease air flow into the ICE. The ICE acts as an air pump with the mass flow rate of air entering the engine varying directly with throttle plate angular position or area. Presently, there is a need in the art to precisely control throttle plate position in a throttle body to tightly regulate the flow of air and fuel into a cylinder.

In the operation of a standard vehicle ICE, a driver will depress the accelerator pedal to generate a major portion of a throttle plate position command to vary the throttle plate angle and accordingly the air flow into the ICE. A controller coupled to a fuel injector, monitoring various engine variables, will regulate the fuel that is mixed with the air, such that the injected fuel generally increases in proportion to air flow. If a carburetor is used, the air flow through the carburetor will directly regulate the amount of fuel mixed with the air, with respect to the vacuum or suction formed by the air flow through the throttle body. For any given fuel-air mixture, the power produced by the ICE is directly proportional to the mass flow rate of air into the ICE controlled by the throttle plate position.

The positioning and stability of the throttle plate directly affects the tuning or stability of the ICE. Ideally, when a position command is given to position the throttle plate, the throttle plate will step to that exact position without a large amount of overshoot and undershoot and at a desired angular speed.

When a driver of a vehicle thinks about pushing the accelerator pedal, the intention to accelerate is being communicated from the mind of the driver to the car, through the movement of the foot. The interface between the driver and the vehicle is the accelerator pedal, which takes a finite amount of time to settle into a final position. The accelerator pedal position is translated through a calibration, to the systems that control the throttle plate within the throttle body, to produce the desired amount of torque output from the ICE. This sequence of events culminates in an "acceleration" that the driver desired at the time he/she depressed the accelerator pedal.

In most cases, there exists a physical time delay from control input at the accelerator pedal, which may be described as the initial incremental change in pedal position, to the throttle final position of the throttle plate. The commanded throttle position is typically embedded within the calibration as a two-dimensional look-up table (pedal position and vehicle speed inputs, throttle position output). The driver observes this physical delay as a lag in the vehicle's responsiveness. Although in maintaining certain brand characteristics such a damped response is desirable, in all vehicles certain maneuvers warrant an immediate response by the vehicle (for example, in an aggressive start from a stop and in a passing maneuver from 50 mph to 80 mph). In such driving conditions, the driver consciously demands an immediate response. The time between the initial movements of the pedal, to the final position of the pedal that the driver's foot settles to, is on the order of tenths of a second. This time delay is built into the throttle response lag and is undesirable as perceived by the consumer. This delay is further compounded by the transient response of the engine caused by physical delays such as the inertia of filling air into the intake manifold. The torque generated during a transient response by an ICE is usually less than at equivalent steady state operating points for the ICE.

SUMMARY OF THE INVENTION

The present invention is a method and apparatus to reduce the amount of time between the driver's desire for acceleration and the vehicle's response, allowing the vehicle to react to the driver's requests relatively quicker than in past applications. Typically, a driver who desires acceleration applies a force at the accelerator pedal. The accelerator pedal moves due to the force with a certain kinetic energy (velocity) and acceleration associated with it. The accelerator pedal generates a resistance to motion due to a spring as well as friction in the mechanism. The accelerator pedal settles at a final position once the kinetic energy is dissipated and is stored as potential energy within the compressed spring. This transfer of energy from kinetic to potential energy occurs over a certain time. It is this time that may be regarded as an undesirable delay in vehicle response by the driver.

In an actual driving situation, the driver does not apply an instantaneous force (or high jerk) by stabbing at the accelerator pedal and taking his foot off, to let the accelerator pedal settle to a final position after overcoming the spring force. Instead, the driver typically applies a continuous force. This causes the accelerator pedal velocity to vary with time. The final position that the accelerator pedal would come to rest at under the influence of the instantaneous force varies with time correspondingly. The ability to predict that final position of an accelerator pedal based on instantaneous pedal velocity will reduce the delay in response by the vehicle.

As described previously, accelerator pedal movement has a certain rate associated with it. If the progression/control of the throttle plate takes the accelerator pedal rate into account, a prediction of final desired throttle blade position can be made. This determination can be made from a map that scales throttle position based on accelerator pedal rate. The scaling factor based on pedal rate can also be created to compensate for the lower transient torque delivered at a given operating point of the ICE. By predicting the resting point of the accelerator pedal and communicating the predicted resting point to an electronic throttle, the responsiveness of the vehicle will be improved.

DESCRIPTION OF THE PREFERRED EMBODIMENT

Figure 1:
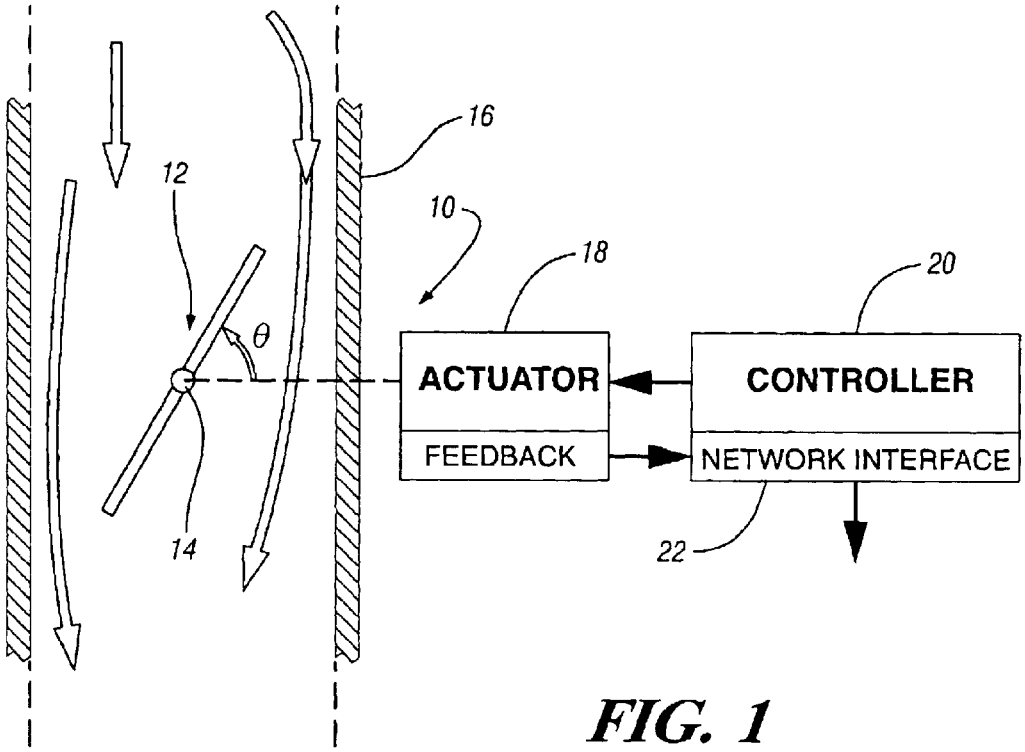
FIG. 1 is a diagrammatic drawing of an electronic throttle system of the present invention.

FIG. 1 is a diagrammatic drawing of an electronic throttle system 10 of the present invention. The system includes a throttle plate 12 which may be rotated to an angular position θ about pivot axis 14 within a throttle body 16 to control air flow to an internal combustion engine (ICE). If the angle θ is equal to zero, the throttle plate 12 will be in a position of maximum air flow constriction, and if the angle θ is equal to ninety degrees, the throttle plate 12 will be in a position of maximum air flow. Accordingly, the air flow may have varying flow rates when the angle θ is varied between zero and ninety degrees. The throttle plate is moved by an actuator 18 such as an electric motor. The electronic throttle system 10 may utilize any known electric motor or actuation technology in the art including, but not limited to, DC motors, AC motors, permanent magnet brushless motors, and reluctance motors.

An electronic throttle controller 20 includes power circuitry to modulate the electronic throttle 12, via the actuator 18, and circuitry to receive position and speed input from throttle plate. In the preferred embodiment of the present invention, an absolute rotary encoder is coupled to the electronic throttle plate 12 and/or actuator to provide speed and position information to the electronic throttle controller 20. In alternate embodiments of the present invention, a potentiometer may be used to provide speed and position information for the throttle plate 12. The electronic throttle controller 20 further includes communication circuitry 22 such as a serial link or automotive communication network interface to communicate with the powertrain controller over an automotive communications network. In alternate embodiments of the present invention, the electronic throttle controller 20 may be fully integrated into a powertrain controller to eliminate the need for a physically separate electronic throttle controller.

Figure 2A:
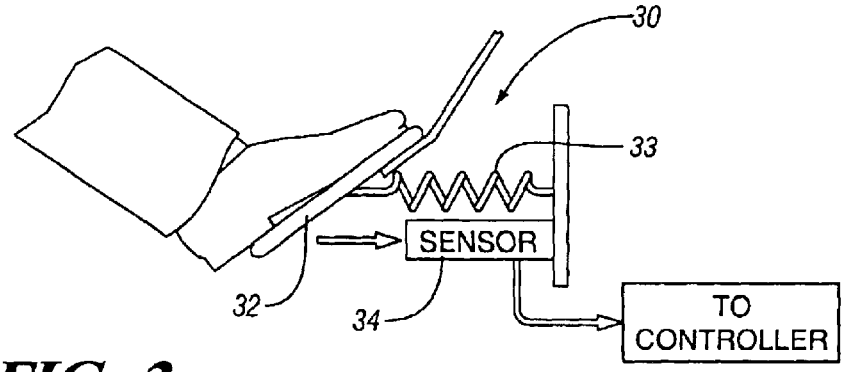
FIGS. 2*a* and 2*b* are diagrammatic drawings of an accelerator pedal model of the present invention.
Figure 2B:
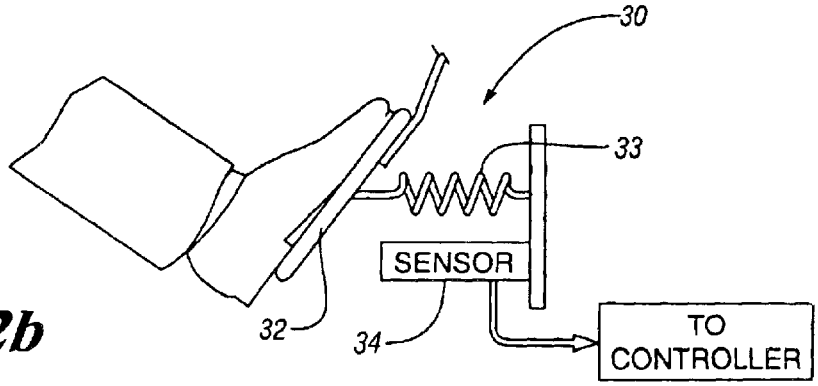

FIGS. 2*a* and 2*b* are diagrammatic drawings of an accelerator pedal model 30 of the present invention. An accelerator pedal 32 in a vehicle is equipped with an accelerator pedal sensor 34 to determine the movement rate, frequency and/or amount of pressure generated by an operator of the vehicle on the accelerator pedal 32. The accelerator pedal 32 movement is opposed by a spring 33, as is known in the art. The accelerator pedal sensor 34 generates a signal to the controller 20. In the preferred embodiment of the present invention, the accelerator pedal sensor 34 is a digital encoder but may also comprise a potentiometer, strain gauge, or similar displacement or force sensor.

The following variables will be used to describe the present invention:

Linear pedal spring constant, $K_p$;

Pedal displacement required to absorb driver applied force, x;

Initial pedal position, Xo;

Final pedal position, X;

Time to apply, t;

Pedal rate, u=dx/dt;

Effective mass of the pedal including linkage, $M_p$;

Kinetic Energy of the pedal, K.E;

Energy absorbed by spring, $W_p$;

Pedal force, $P_f$

When the operator actuates the accelerator pedal 32, the energy exerted by the operator must be balanced by the system 30. Thus, the initial kinetic energy of the pedal 32=Energy absorbed by the spring 33 (including frictional work dissipated within the linkage)

Calculating initial kinetic energy, K.E.

$$K.E. = \frac{1}{2} M_p * u^2$$

Incremental energy absorbed by spring 33, $dW_p$ over the incremental distance, dx $$dW_p = P_f * dx$$

By integrating over the pedal 32 displacement, x:

$$\int_0^x dW_p = \int_0^x K_p * x \cdot dx$$

$$W_p = \frac{1}{2} * K_p * x^2$$

Since K.E.=$W_p$, it can be shown that $$x = u * \sqrt{\frac{M_p}{K_p}}$$

And the final pedal 32 position (X) will be $$X = Xo + x$$

$$X = Xo + \left(u * \sqrt{\frac{M_p}{K_p}}\right)$$

X can therefore be predicted in real time as the instantaneous pedal 32 rate varies.

Figure 3:
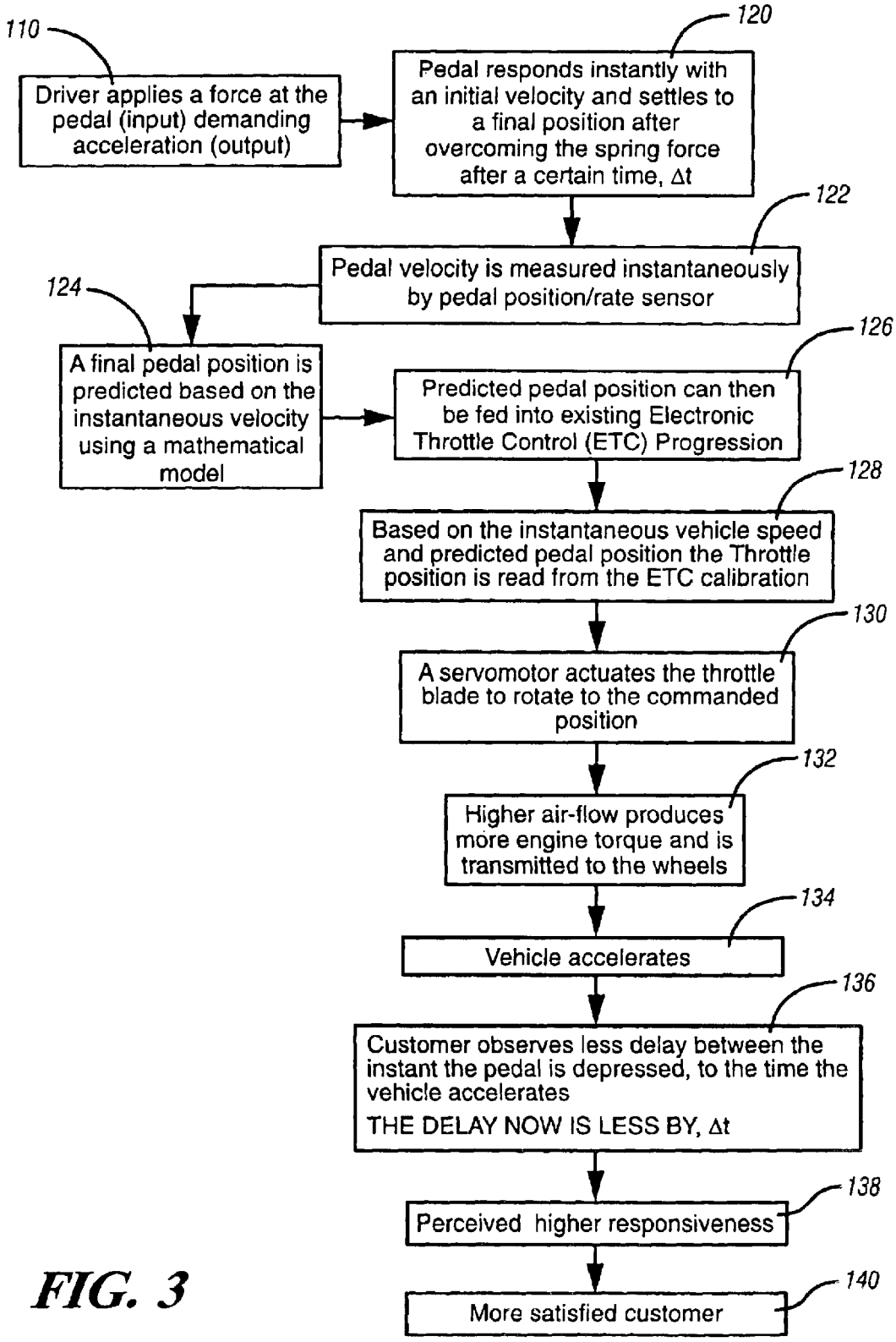
FIG. 3 is a flowchart of a preferred method of the present invention.

FIG. 3 is a flowchart of the sequence of events used to implement the method of the present invention. Starting at block 110, the driver applies a force at the accelerator pedal 32 demanding an acceleration output from an ICE. The pedal 32 at block 120 responds with an initial velocity and settles to a final position after overcoming the spring force of spring 31 after a certain time. At block 122, a controller such as a powertrain controller or electronic throttle control (ETC) controller 20 measures the pedal 32 velocity instantaneously with pedal sensor 34. At block 124, a final pedal 32 position is predicted based on the instantaneous velocity using the mathematical model described previously. The predicted pedal position, at block 126, is communicated to the ETC controller 20 and/or powertrain controller to command an existing electronic throttle control progression program. At block 128, based on the instantaneous vehicle speed and predicted pedal 32 position, the throttle position is read from an ETC calibration. The actuator 18, at block 130, moves the throttle blade 12 to the commanded position. Higher air flow produces more engine torque at block 132 and the vehicle accelerates (under most operating conditions) at block 134. The customer observes less delay between the pedal 32 depression and vehicle acceleration at block 136. Blocks 138 illustrated the perceived higher responsiveness of the vehicle and the satisfaction that is shown by a customer or driver of the vehicle equipped with the present system.

Figure 4:
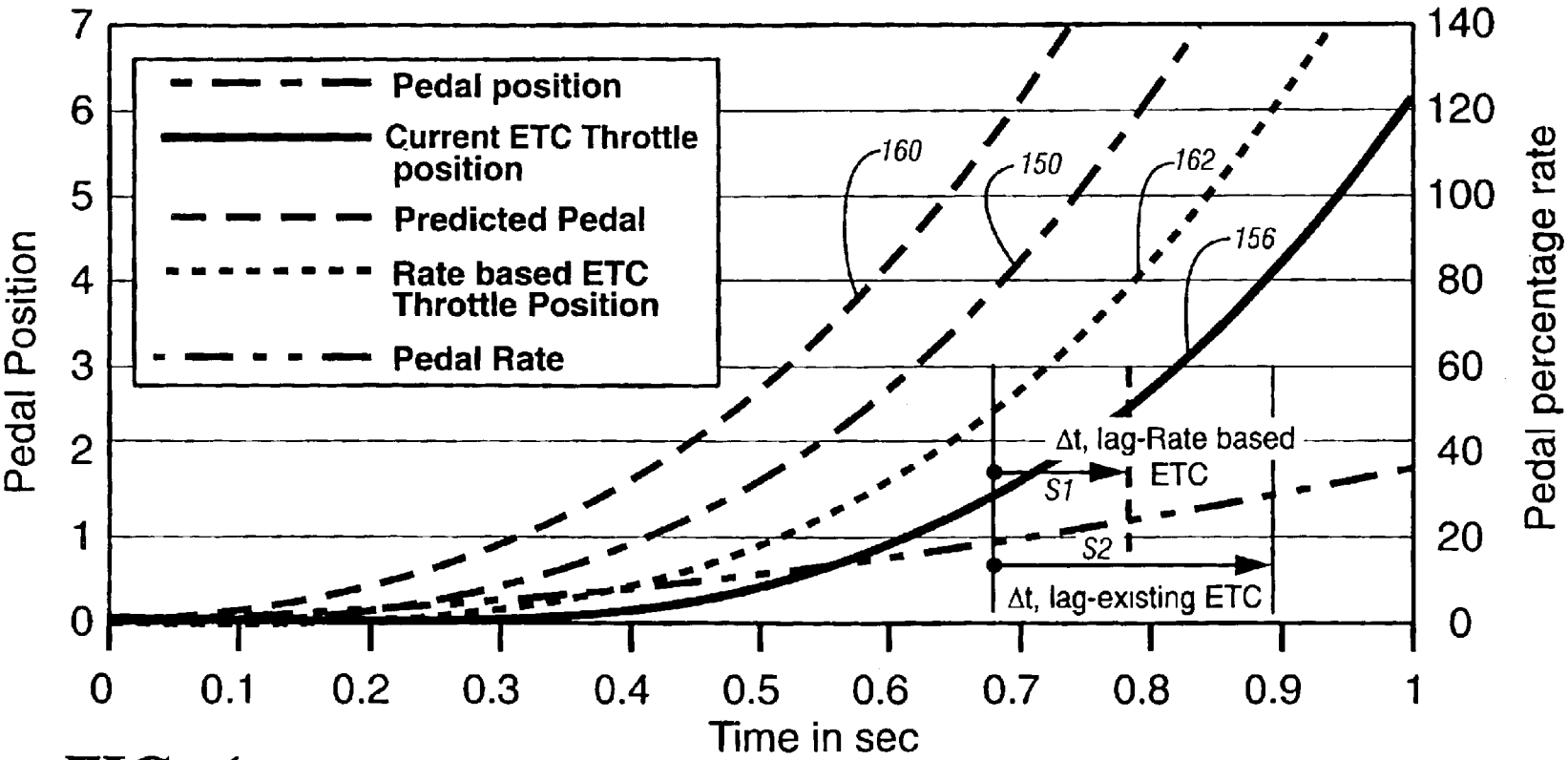
FIG. 4 is a plot of the performance of the present invention.

FIG. 4 includes a series of plots illustrating the performance of the present invention. Plot 150 is a profile of pedal 32 position versus time as the driver applies a continuous force at the accelerator pedal. Plot 156 is a profile of the current position of the throttle blade 12 over time showing the response of the throttle blade 12 as actuated by the throttle control mechanism. Plot 160 is a profile of predicted pedal 12 position as determined in real time within the modified calibration (as determined through predictive model outlined in this invention) is also shown on the same plot. Plot 162 is a profile of the rate-based throttle position versus time. S1 indicates the time lag that the driver currently experiences from the instant the pedal 32 is depressed to the instant that the throttle blade 12 settles to the position commanded using conventional ETC progressions. S2 indicates the time lag between the instant the pedal 32 is depressed to the instant that the throttle blade 12 settles to position commanded using the proposed pedal rate based ETC progressions. The difference between S1 and S2 is the time that the vehicle's responsiveness has improved utilizing the present invention.

While this invention has been described in terms of some specific embodiments, it will be appreciated that other forms can readily be adapted by one skilled in the art. Accordingly, the scope of this invention is to be considered limited only by the following claims.

What is claimed is:

1. An engine control system in a vehicle comprising:

an internal combustion engine;

an electronic throttle controlling air flow to said internal combustion engine;

a controller controlling the position of said electronic throttle;

an accelerator pedal having an accelerator pedal sensor which generates a signal to said controller;

wherein said controller computes a rate of change for said accelerator pedal and actuates said electronic throttle to a desired position based upon said rate of change for said accelerator pedal; and wherein said predicted rate of change for said accelerator pedal is based upon at least a spring force of said accelerator pedal.

2. The engine control system of claim 1 wherein said rate of change for said accelerator pedal comprises a rate of position change.

3. The engine control system of claim 1 wherein rate of change for said accelerator pedal comprises a rate of force change.

4. The engine control system of claim 1 wherein said internal combustion engine is a gasoline engine.

5. The engine control system of claim 1 wherein said accelerator pedal sensor is a linear encoder.

6. The engine control system of claim 1 wherein said accelerator pedal sensor is a potentiometer.

7. The engine control system of claim 1 wherein said accelerator pedal sensor is a strain gauge.

8. An engine control system in a vehicle comprising:

an internal combustion engine;

a throttle controlling air flow to said internal combustion engine;

a controller controlling the position of said electronic throttle;

an accelerator pedal having an accelerator pedal sensor which generates a signal to said controller;

wherein said controller predicts a rate of change for said accelerator pedal and actuates said electronic throttle to a desired position based upon said predicted rate of change for said accelerator pedal; and wherein said predicted rate of change for said accelerator pedal is based upon at least a spring force of said accelerator pedal.

9. The engine control system claim 8 wherein said rate of change for said accelerator pedal comprises a rate of position change.

10. The engine control system of claim 8 wherein said rate of change for said accelerator pedal comprises a rate of force change.

11. The engine control system of claim 8 wherein said internal combustion engine is a gasoline engine.

12. The engine control system of claim 8 wherein said accelerator pedal sensor is a linear encoder.

13. The engine control system of claim 8 wherein said accelerator pedal sensor is a potentiometer.

14. The engine control system of claim 8 wherein said predicted rate of change is bated on the mass of said accelerator pedal.

* * * * *